US011286767B2

(12) United States Patent
Holly et al.

(10) Patent No.: US 11,286,767 B2
(45) Date of Patent: Mar. 29, 2022

(54) ACCESSIBLE WELLBORE DEVICES

(71) Applicant: Halliburton Energy Services, Inc., Houston, TX (US)

(72) Inventors: Mark S. Holly, The Colony, TX (US); Kevin Dwain Fink, Jr., McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 5 days.

(21) Appl. No.: 16/630,591

(22) PCT Filed: Mar. 29, 2019

(86) PCT No.: PCT/US2019/024767
§ 371 (c)(1),
(2) Date: Jan. 13, 2020

(87) PCT Pub. No.: WO2020/204874
PCT Pub. Date: Oct. 8, 2020

(65) Prior Publication Data

US 2021/0230996 A1 Jul. 29, 2021

(51) Int. Cl.
*E21B 47/01* (2012.01)
*E21B 47/13* (2012.01)

(52) U.S. Cl.
CPC ..... *E21B 47/01* (2013.01); *E21B 47/13* (2020.05)

(58) Field of Classification Search
CPC ..... E21B 47/01; E21B 47/13
See application file for complete search history.

(56) References Cited

U.S. PATENT DOCUMENTS

| | | | |
|---|---|---|---|
| 5,412,568 | A | 5/1995 | Schultz et al. |
| 5,458,200 | A | 10/1995 | Lagerlef et al. |
| 5,839,508 | A | 11/1998 | Tubel et al. |
| 6,070,608 | A | 6/2000 | Pringle |
| 6,182,764 | B1 | 2/2001 | Vaynshteyn |
| 6,230,812 | B1 | 5/2001 | Reaux et al. |

(Continued)

FOREIGN PATENT DOCUMENTS

| | | | |
|---|---|---|---|
| EP | 2642066 | 9/2013 | |
| EP | 2642066 A1 * | 9/2013 | ..... E21B 47/26 |

(Continued)

OTHER PUBLICATIONS

International Application No. PCT/US2019/024767, International Search Report and Written Opinion, dated Dec. 20, 2019, 13 pages.

(Continued)

*Primary Examiner* — Caroline N Butcher
(74) *Attorney, Agent, or Firm* — Kilpatrick Townsend & Stockton LLP

(57) ABSTRACT

A wellbore assembly for use downhole in a wellbore may include a casing string comprising a mandrel. The mandrel may include a side pocket in an inner region of the mandrel. A downhole device may be positioned within the side pocket of the mandrel. The downhole device may include an electronics package, a power source, and a transmitter for transmitting data from the downhole device via a wireless communications link to a downhole tool for transmitting the data to a surface of the wellbore for monitoring a downhole environment of the wellbore.

20 Claims, 3 Drawing Sheets

(56) References Cited

U.S. PATENT DOCUMENTS

| | | | | |
|---|---|---|---|---|
| 6,343,651 | B1 | 2/2002 | Bixenman | |
| 7,158,446 | B2 | 1/2007 | Gardner et al. | |
| 7,171,309 | B2 | 1/2007 | Goodman et al. | |
| 7,676,680 | B2 | 3/2010 | Seelos et al. | |
| 7,989,113 | B2 | 8/2011 | Fujita et al. | |
| 8,033,328 | B2 | 10/2011 | Hall et al. | |
| 8,169,854 | B2 | 5/2012 | Godager et al. | |
| 8,196,678 | B2 | 6/2012 | Jeffryes | |
| 8,319,657 | B2 | 11/2012 | Godager et al. | |
| 8,528,395 | B2 | 9/2013 | Griffiths et al. | |
| 8,678,035 | B2 | 3/2014 | Fripp et al. | |
| 8,701,771 | B2 | 4/2014 | Dykstra et al. | |
| 8,752,629 | B2 | 6/2014 | Moen | |
| 8,893,809 | B2 | 11/2014 | Charles et al. | |
| 8,994,550 | B2 * | 3/2015 | Millot | E21B 47/13 340/854.4 |
| 2002/0020533 | A1 | 2/2002 | Tubel et al. | |
| 2002/0029883 | A1 | 3/2002 | Vinegar et al. | |
| 2003/0164240 | A1 | 9/2003 | Vinegar et al. | |
| 2008/0130412 | A1 | 6/2008 | Fink et al. | |
| 2009/0008078 | A1 | 1/2009 | Patel | |
| 2009/0164240 | A1 | 6/2009 | Friedmann et al. | |
| 2011/0180267 | A1 | 7/2011 | Wildman et al. | |
| 2011/0192596 | A1 | 8/2011 | Patel | |
| 2012/0067567 | A1 | 3/2012 | Rytlewski et al. | |
| 2014/0069639 | A1 | 3/2014 | Mackenzie et al. | |
| 2016/0108692 | A1 | 4/2016 | Scott | |
| 2017/0335679 | A1 | 11/2017 | Tubel et al. | |
| 2018/0010449 | A1 | 1/2018 | Roberson et al. | |
| 2018/0058202 | A1 | 3/2018 | Disko et al. | |
| 2019/0024477 | A1 | 1/2019 | Coulston | |

FOREIGN PATENT DOCUMENTS

| | | | | |
|---|---|---|---|---|
| GB | 2407335 A | * | 4/2005 | E21B 47/13 |
| WO | WO-2016181154 A1 | * | 11/2016 | E21B 47/06 |
| WO | 2018093377 | | 5/2018 | |
| WO | 2018093378 | | 5/2018 | |

OTHER PUBLICATIONS

Schlumberger , "WRFC-H Wireline-retrievable flow control valve for gas lift applications", 2010, 2 pages.

* cited by examiner

ACCESSIBLE WELLBORE DEVICES

TECHNICAL FIELD

The present disclosure relates generally to assemblies and devices for use in a subterranean wellbore and their use, and more particularly (although not necessarily exclusively), to assemblies and devices and methods of their use for monitoring conditions within a wellbore.

BACKGROUND

A well may include a casing string extending downhole into the wellbore. Devices, including wireless sensors, may be deployed on a casing string for collecting and transmitting data related to the environment within the wellbore. The casing string, including the devices thereon, is intended to remain within the well for the life of the well. A device positioned downhole may be exposed to an extreme environment, including extreme heat and pressure. The design of such devices can be challenging, such as to ensure reliability of the electronics and resist harm, such as broken, degraded, or damaged equipment due to the extreme environment. Even a device that survives the extreme environment downhole can eventually become outdated as technology advances, especially given that the life of the well may continue for five, ten, fifteen, twenty, or even thirty-plus years.

DETAILED DESCRIPTION

Figure 1:
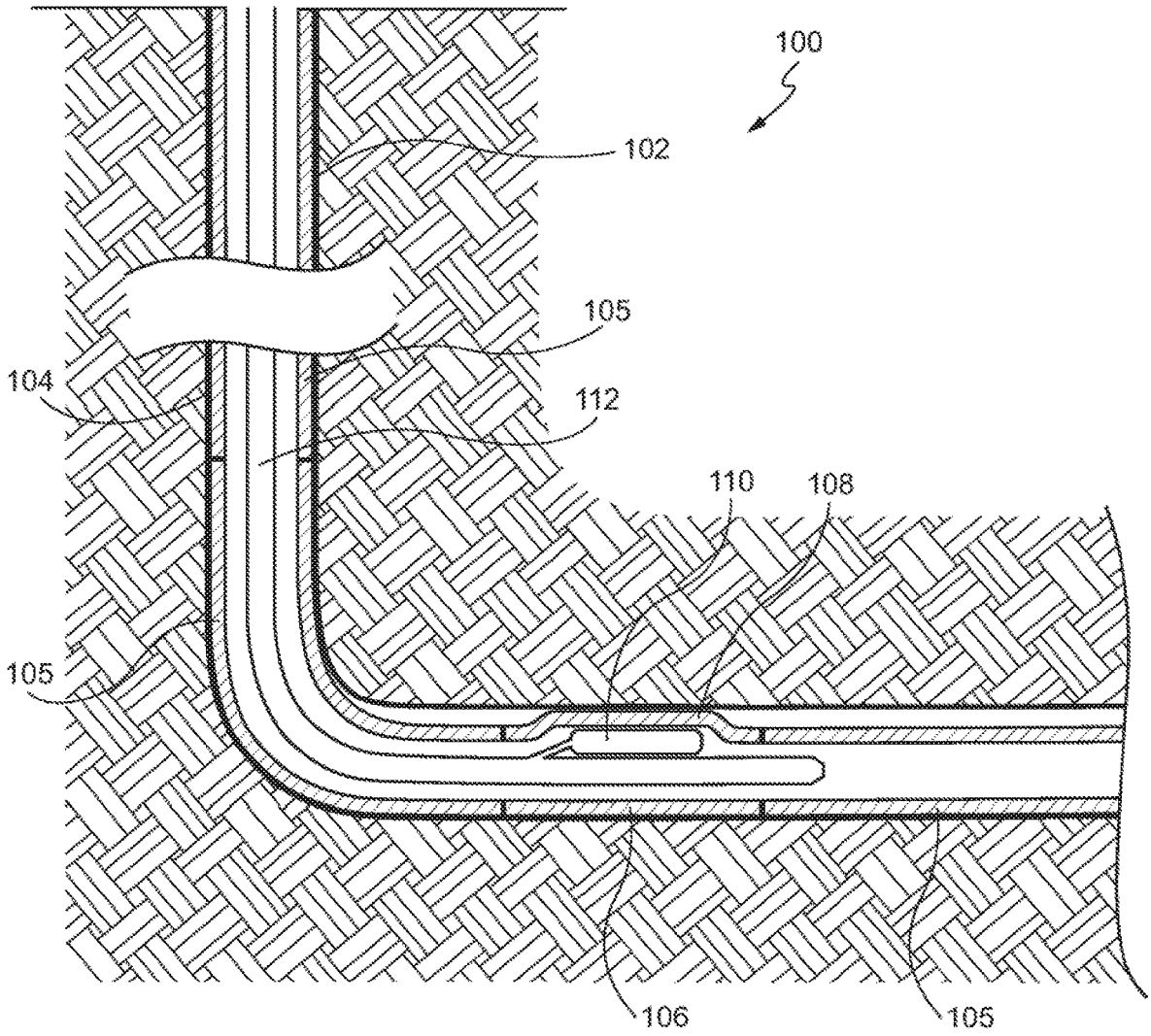
FIG. 1 is a schematic illustration of a wellbore including a mandrel positioned between joints of a casing string.

Aspects of this disclosure include devices and methods to remove the casing string or a portion thereof, or individual devices, to replace, repair, upgrade or otherwise alter the devices included on the casing string. More specifically, in at least one example, a mandrel of a casing string includes a side pocket (hereinafter a "side pocket mandrel") for retaining a device to permit the recharging, replacement, and/or updating (e.g. software and/or hardware) of the device without removing the mandrel or the surrounding casing string from the wellbore. This can reduce costs associated with the long term use of the device and can extend the life of the device. The function of devices downhole can also be optimized according to aspects of the present disclosure.

Certain aspects and features of the present disclosure relate to a device positioned on a mandrel of a casing string, or on a mandrel positioned between casing joints of a casing string. The mandrel may include a side pocket. The side pocket may house a device, for example but not limited to a device for collecting and transmitting data regarding the downhole environment. The device may be positioned within the side pocket of the mandrel prior to the installation of the mandrel downhole or after the installation of the mandrel downhole, for example by a downhole tool (e.g. slickline, wireline, or digital slickline). The device may also be retrieved from the side pocket of the mandrel by the downhole tool and returned to the surface for repair, replacement, or upgrading. In some aspects, the device may be retrieved to have its hardware or software upgraded following technological advancements that have been made since the device was initially positioned within the casing string, The device may be returned to the side pocket of the mandrel (while the casing string remains downhole) by the tool after repair/replacement/upgrading of the device. In some aspects, the device may receive hardware or software updates in situ within the side pocket of the mandrel via a tool positioned downhole. In some aspects, the power source of the device may be recharged, removed, or replaced by a tool positioned downhole while the device is positioned within the side pocket of the mandrel. The device may collect data relating to the environment within an inner region of the casing string or on the outside of the casing string in an annulus between the casing string and the wellbore. The device may transmit the data collected via a wireless communications link to a downhole tool positioned within the wellbore. The downhole tool may transmit the data collected from one or more devices positioned within side pocket mandrels of the casing string to a surface of the wellbore. The downhole tool may include slickline (e.g. digital slickline) or wireline.

The device need not be manufactured to survive the entire lifetime of a well given it may be retrieved and returned to the surface to be replaced, repaired, or upgraded. Thus, the cost of manufacture of the device may be reduced. The efficiency of the well may also improve by permitting repair, updating, recharging or otherwise servicing the device while it is downhole using a downhole tool. In some aspects, the device may be retrieved from the side pocket in the casing string for repair or replacement at the surface. By allowing broken or poorly functioning devices to be repaired or replaced without removal of the casing string itself the efficiency of the well can be improved. Retrieval of data collected by the device or devices within the casing string via a wireless communications link between the device or devices and a downhole tool may also improve efficiency of the well.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts by schematic illustration an example of a well system 100 that includes a bore that is a wellbore 102 extending through various earth strata. A casing string 104 made up of a plurality of mandrels or pipes 105 may extend downhole within the wellbore 102. The casing string 104 may remain in the wellbore 102 for the life of the well. The casing string 104 may include a mandrel 106 positioned between two pipes 105 or casing joints of the casing string 104. The mandrel 106 may be referred to as a joint of the casing string 104. The mandrel 106 may be a side pocket mandrel that includes include a side pocket 108. The side pocket 108 may be within an inner region of the mandrel 106 and may be defined by an inner surface of the mandrel 106. In some aspects, the side pocket 108 may also be defined by an arm or other structure extending from the wall of the mandrel 106. The side pocket 108 may extend into an annulus of the wellbore so as not to obstruct a pathway defined by the inner region of the mandrel 106, which may enable access to the wellbore and components below. Thus, an inner diameter of the inner region of the mandrel 106 may be greater at the side pocket 108 than at another portion of the mandrel 106. The mandrel 106 may include more side pockets 108 than are shown in FIG. 1.

A device 110 may be positioned within the side pocket 108 of the mandrel 106. In some aspects, the device 110 may include an electronics package, for example but not limited to a sensor (e.g., pressure sensor, flow rate sensor, or flow composition sensor), an actuator, a wireless communications module (e.g. a wireless transceiver for wireless telemetry) or other electronics package for use downhole. In some aspects, the device 110 may include a valve assembly. In some aspects, the valve assembly may be an electronic valve assembly. In still yet other aspects, the device 110 may be a downhole power generator that converts flow energy to electrical energy.

A tool 112 may be positioned within an inner diameter or inner region of the casing string 104. In FIG. 1 the tool 112 is coupled to the device 110 for inserting the device 110 into the side pocket 108 of the mandrel 106. The tool 112 may be a kick-over-tool that may be decoupled from the device 110 and removed from the wellbore 102 after installation of the device 110 within the side pocket 108. The tool 112 may also be used to remove the device 110 from the side pocket 108 or to remove or access portions of the device 110 (e.g., an electronics package, an actuator, or a power source). In some aspects, the tool 112 may be positioned on wireline or slickline. In some aspects, the tool 112 may include a wireless communications module (e.g. for example a receiver, a transceiver, or transmitter) for forming a wireless communications link between the device 110 and the tool 112.

In some aspects, the tool 112 may receive data from the device 110, for example but not limited data collected by a sensor of the device 110. In some aspects, the tool 112 may transmit data to the device 110. For example, the tool 112 may transmit a software upgrade to the device 110 that changes the performance of the device 110. In some aspects, the tool 112 may conduct hardware upgrades or other changes to the device 110. In some aspects, the tool 112 may recharge or replace a power source of the device 110. In still yet other aspects, the tool 112 may interact with the device 110 in other ways, for example by sending data to or receiving data from the device 110 (e.g. via the wireless communications link). The ability to recharge or replace features of the device 110 can extend the period of time a well may be monitored with minimal well intervention, for example by providing maintenance to the device 110 using slickline (including digital slickline) or wireline such that the casing string 104 does not need to be pulled from the wellbore 102 to conduct the maintenance. In some aspects, the tool 112 may be in wired communication with the device 110.

Figure 2:
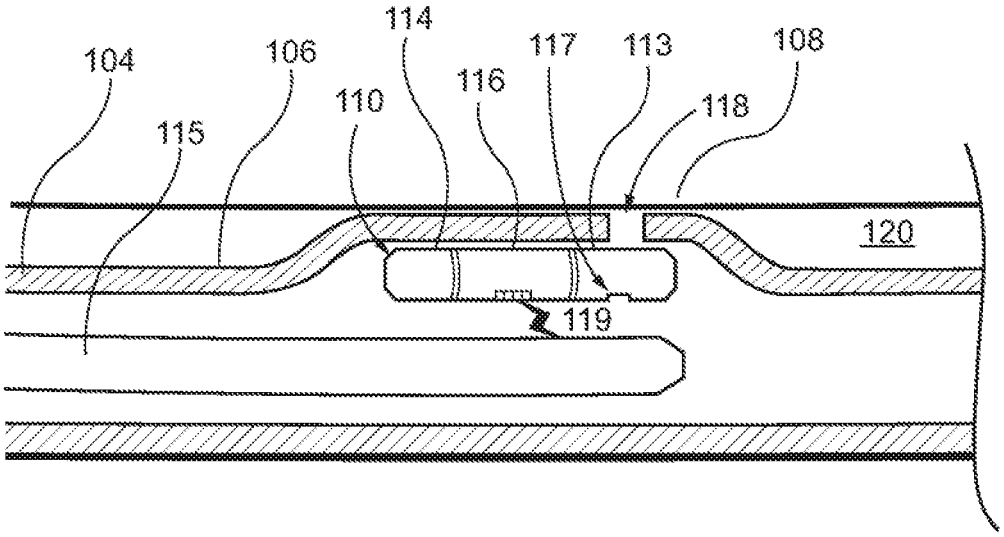
FIG. 2 is a cross-sectional side view of a casing string positioned within a wellbore, according to an aspect of the present disclosure.

FIG. 2 depicts a cross-sectional side view of a side pocket mandrel within a wellbore according to some aspects of the present disclosure, for example the mandrel 106 within which the device 110 is positioned. The device 110 may include multiple features including but not limited to an electronics package 113, a power source 114, and an adaptor 116. In some aspects, the electronics package 113 may include a sensor, a valve assembly, an actuator, a receiver (e.g. a wireless receiver), a transmitter, or another downhole tool. The sensor may be a temperature sensor, a pressure sensor, a flow rate sensor, or another sensor for use downhole. The electronics package 113 may have a region 117 that is sized and shaped to couple to a tool, for example a tool 115 or the tool 112 (shown in FIG. 1). The electronics package 113 may be inserted into the side pocket 108 or removed from the side pocket 108 by a tool (e.g. as shown in FIG. 1). The tool 115 (or 112 shown in FIG. 1) may couple to the electronics package 113 to remove the electronics package 113 from the side pocket 108 of the mandrel 106 for return to the surface of the wellbore 102 for repair or replacement.

The electronics package 113 may also receive data from the tool 115 or another tool positioned downhole (e.g. tool 112 shown in FIG. 1). The electronics package 113 and the tool 115 may communicate wirelessly via a wireless communications link 119. In some aspects, the electronics package 113 may receive instructions from the tool 115 related to the electronics package 113 functions, for example but not limited to a status, a mission profile, or schedule for the electronics package 113. For example, instructions can relate to how the electronics package 113 is to perform (e.g., timing for turning on and off of a sensor for collecting data downhole, timing for turning on and off of a transmitter for transmitting data, timing for turning on and off a receiver for receiving instructions from a downhole tool) for optimizing the performance of the electronics package 113. The tool 115 can for example transmit instructions related to a duty cycle of the electronics package 113 which may extend the longevity of the electronics package and extend the time of the service provided by the electronics package 113. In some aspects, the electronics package 113, including for example a wireless receiver, may also communicate with the tool 115 via the wireless communications link 119 to do a status check to insure proper operations and estimation on when to service the electronics package 113 in the future (e.g., battery life remaining or other data). The electronics package 113 may communicate with the tool 115 via acoustic telemetry or other suitable wireless communications methods. In some aspects, the tool 115 may include slickline or wireline.

In some aspects, the side pocket 108 of the mandrel 106 may include a port 118. The port 118 may provide access to an annulus 120 between the wellbore 102 and the mandrel 106. The electronics package 113 may collect data related to the environment in the annulus 120 via the port 118. In some aspects, fewer or more ports may be included. Any such ports may be positioned elsewhere along the mandrel 106. In some aspects, the electronics package 113 may monitor and collect data related to the environment within the side pocket 108 and the casing string. Thus, the electronics package 113 may in some aspects collect data related to the environment within the casing string and in some aspects may collect data related to the environment in the annulus 120.

The electronics package 113 may also transmit data, including but not limited to data collected about the downhole environment by the electronics package 113. In some aspects, the electronics package 113 may wirelessly transmit data to the tool 115 or another tool positioned downhole via a wireless communications link (e.g. wireless communications link 119). The tool 115 may include for example wireline or slickline (e.g. digital slickline) and may receive data from the electronics package 113, for example via a wireless receiver, and transmit the data received from the electronics package 113 to a device at a surface of the wellbore 102 that is positioned at some distance from the tool 115, for example via acoustic telemetry. Thus, in some aspects, the electronics package 113 may collect data in its downhole position and may transmit that data some distance to the tool 115 using wireless communication link 119. The tool 115 may transmit the data some distance to the surface via a wired or wireless communications link to the surface of the wellbore.

The electronics package 113 may be powered by the power source 114. The power source 114 may include a battery, a generator, or other suitable power source for providing power to the electronics package 113. The power source 114 in some aspects may be a removable power source, for example a battery pack that may be removed from the side pocket 108 of the mandrel 106 and replaced with a new power source (e.g. a new battery pack). The power source 114 may be removed and/or replaced via a tool, for example tool 115 (or tool 112 shown in FIG. 1). The ability to remove and replace the power source 114 without removing the casing string 104 can reduce costs associated with the downhole system and can increase the longevity of the system including the electronics package 113.

In some aspects, the power source 114 may be a rechargeable power source. For example, the power source 114 may be recharged via a tool, including but not limited to tool 115 by capacitive interface, inductive interface, magnetic interface, or a direct connections. For example, FIG. 2 depicts the adaptor 116 which may be an adaptor for coupling a tool (e.g. tool 112) to the power source 114 for recharging the power source 114. In some aspects, the adaptor 116 may be a wet-stab connector or other suitable connection for recharging the power source 114 via a downhole tool (e.g., tool 115 or tool 112 shown in FIG. 1).

One or more of the electronics package 113, the power source 114, or the adaptor 116 can be inserted into or removed from the side pockets 108 of the mandrel 106 via a tool (e.g. tool 115 or tool 112 shown in FIG. 1). In some aspects one or more of the electronics package 113, the power source 114, or the adaptor 116 may be positioned in a separate side pocket, for example but not limited to another side pocket in the mandrel 106 or another side pocket in a different mandrel. The electronics package 113, the power source 114, or the adaptor 116 if located in separate side pockets may be connected via thru wires or other suitable connections.

Figure 3:
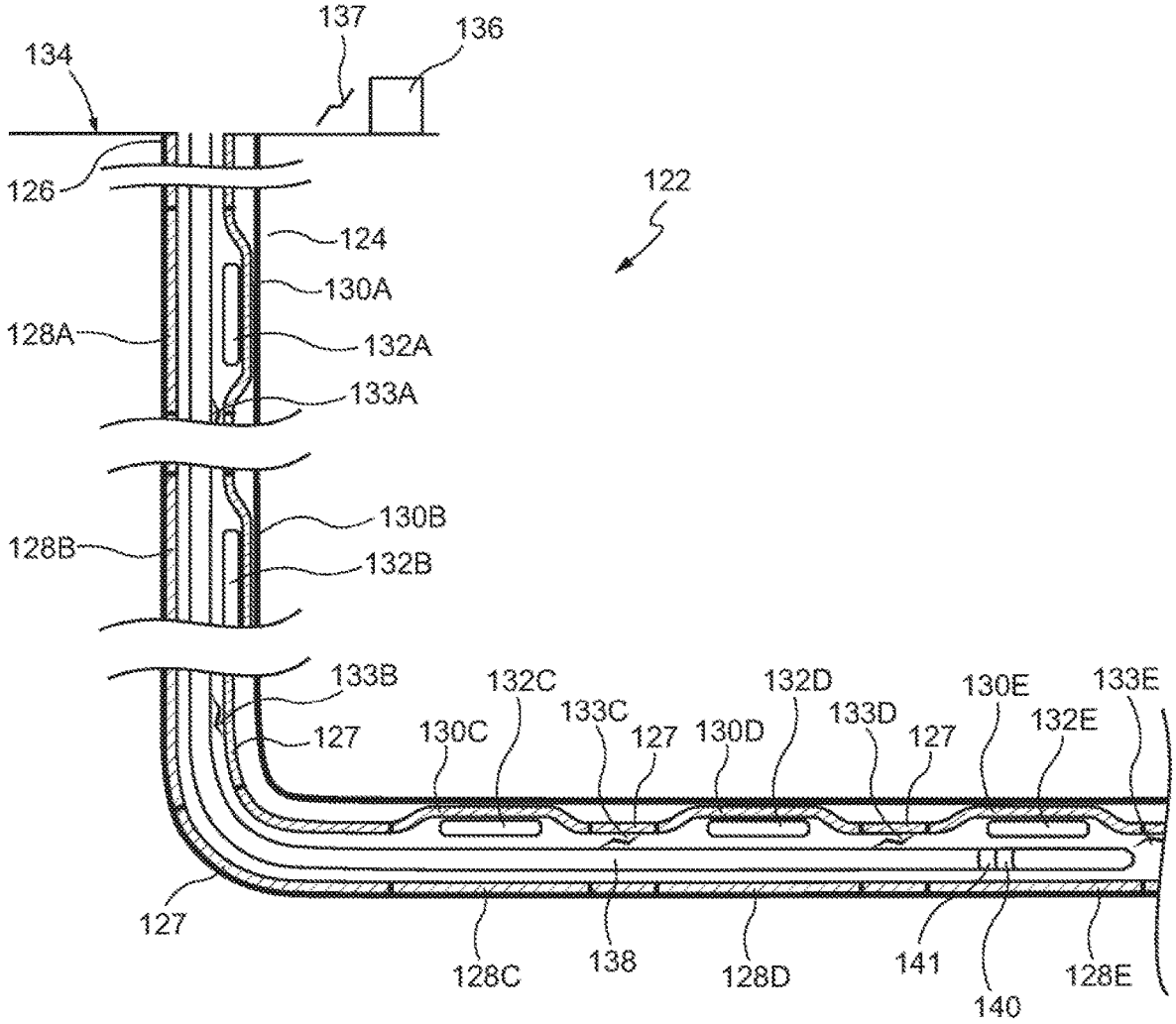
FIG. 3 is a cross-sectional side view of a casing string positioned within a wellbore, according to an aspect of the present disclosure.

FIG. 3 depicts cross-sectional view of a well system 122 including a wellbore 124 within which a casing string 126 is positioned. The casing string 126 may include a plurality of pipes 127. The casing string 126 may also include multiple mandrels which may be side pocket mandrels, for example side pocket mandrel 128A and additional side pocket mandrels 128B-E, each side pocket mandrel may include a side pocket 130A-E. Side pocket mandrels 128A-E may be positioned between pipes 127 of the casing string 126. FIG. 3 depicts downhole devices, for example devices 132A-E respectively within each of the side pockets 130A-E of the side pocket mandrels 128A-E. For example, device 132A may be positioned within the side pocket 130A of the side pocket mandrel 128A and the additional devices 132B-E may respectively be positioned within the additional side pockets 130B-E of the respective side pocket mandrels 128B-E. The devices 132A-E may include the same or different features (e.g. an electronics package, a power source, an adaptor, etc.) as device 110 (shown in FIGS. 1 and 2). The devices 132A may include communication modules, for example but not limited to receivers, transmitters, transceivers or other wired or wireless communication means. Though FIG. 3 depicts six side pocket mandrels 128A-E, in some aspects more or fewer side pocket mandrels may be included in the casing string 126. The side pocket mandrels 128A-E may be positioned at some distance from one another to permit communication between some or all of the devices 132A-E. The devices 132A-E may for example transmit data between one another, including but not limited to data related to software updates, status updates, instructions for data collection, etc. For example, the device 132A may transmit data to one or more of the devices 132B-E or to a downhole tool. Another downhole device, for example device 132B may transmit additional data to one or more of the devices 132A, 132C-E or to a downhole tool. In some aspects, as shown in FIG. 3, the number of side pocket mandrels 128A-E may be sufficient to extend from a surface 134 of the wellbore 124 to a downhole position within the wellbore. The number and spatial positioning of the side pocket mandrels 128A-E may permit devices 132A-E positioned therein to relay data to an adjacent device from a downhole position to a more up-hole position, including all the way up to the surface of the wellbore. For example, the device 132E may transmit data it has collected to the device 132D via wireless communication link 133D. Device 132D may transmit that data (and optionally additional data) to the device 132C via wireless communication link 133C. Device 132 C may transmit that data (and optionally additional data) to the device 132B via wireless communication link 133B. Device 132B may transmit that data (and optionally additional data) to the device 132A via wireless communication link 133A. Device 132A may be positioned at some distance from the surface 134 to permit the device 132 to transmit the data it received from device 132B (and optionally additional data) to a computing device 136 positioned at the surface 134 via a wireless communications link 137, or via a wired communications link. In some aspects, a downhole tool may collect the data from the device 132B for transmission to the surface 134. Thus, in some aspects, data collected downhole by one or more devices within a side pocket of a mandrel may be transmitted further up-hole in the wellbore to a location where it may then be transmitted to a tool positioned within the wellbore, or transmitted all the way to the surface 134 of the wellbore 124 by relaying data from one device to another adjacent device.

In some aspects, a tool 138 positioned downhole may including a receiver 140 for collecting data from one or more of the devices 132A-E positioned within the side pockets 130A-E of the side pocket mandrels 128A-E, in such aspects, the tool 138 may transmit the data to the surface, for example via wireline or slickline. The tool 138 may collect data from the device 132A-E as it passes within a specified range of each of the devices 132A-E, for example via wireless communication, acoustic telemetry or other suitable communication means. The tool 138 may also include a transmitter 141 for transmitting data to one or more of the devices 132A-E.

The devices 132A-E positioned within the side pockets 130A-E of the side pocket mandrels 128A-E may be accessed, replaced, removed, upgraded or otherwise manipulated as described above with respect to the device 110 in FIG. 2. Thus, the well system 122 that includes the devices 132A-E may have an extended life of use as a result of the accessibility of the devices 132A-E using tools such as wireline and slickline cables for repairing, replacing, recharging, upgrading or otherwise manipulating the devices 132A-E without having to remove the casing string 126.

As used below, any reference to a series of examples is to be understood as a reference to each of those examples disjunctively (e.g., "Examples 1-4" is to be understood as "Examples 1, 2, 3, or 4").

Example 1 is a wellbore assembly for use downhole in a wellbore, the wellbore assembly comprising: a casing string comprising a mandrel, the mandrel including a side pocket in an inner region of the mandrel; and a downhole device positioned within the side pocket of the mandrel, the downhole device including an electronics package, a power source, and a transmitter for transmitting data from the downhole device via a wireless communications link to a downhole tool for transmitting the data to a surface of the wellbore for monitoring a downhole environment of the wellbore.

Example 2 is the wellbore assembly of example 1, wherein the downhole device further includes an adaptor for coupling a downhole tool to the power source for recharging the power source via the downhole tool.

Example 3 is the wellbore assembly of example 2, wherein the adaptor is a wet-stab connector.

Example 4 is the wellbore assembly of examples 1-3, wherein the electronics package further Includes a receiver for receiving data from a downhole tool or from another downhole device via the wireless communications link for receiving data from the surface of the wellbore for managing a performance of the downhole device.

Example 5 is the wellbore assembly of examples 1-4, wherein the downhole device includes a region sized and shaped to couple to a downhole tool for positioning the downhole device within the side pocket of the mandrel while the casing string is downhole.

Example 6 is the wellbore assembly of examples 3-5, wherein the power source includes a region sized and shaped for coupling to a downhole tool for removing the power source of the downhole device from the downhole device while the downhole device is positioned in the side pocket of the mandrel.

Example 7 is the wellbore assembly of examples 1-6, also including a port within a wall of the mandrel for providing access to an annulus between the casing string and a wellbore for monitoring the downhole environment in the annulus.

Example 8 is the wellbore assembly of examples 1-7, also including a downhole tool positioned within the wellbore, the downhole tool including a wireless receiver for receiving data from the downhole device via the wireless communications link.

Example 9 is the wellbore assembly of examples 1-8, wherein the downhole device includes at least one of a sensor, a valve assembly, or an actuator.

Example 10 is the wellbore assembly of examples 1-9, wherein the casing string comprises an additional mandrel having a side pocket and an additional downhole device positioned within the side pocket of the additional mandrel, wherein the additional downhole device including an electronics package and a power source.

Example 11 is the wellbore assembly of example 10, wherein the additional downhole device is positioned at a distance to the downhole device for transmitting additional data via a wireless communications link to the downhole device for monitoring the downhole environment of the wellbore.

Example 12 is the wellbore assembly of examples 10-11, wherein the additional downhole device is positioned at a distance to the surface of the wellbore for transmitting data to a device at the surface of the wellbore for monitoring the downhole environment of the wellbore.

Example 13 is a method of monitoring a downhole environment of a wellbore that includes collecting data regarding a downhole environment via a device positioned within a side pocket of a casing string, wherein the side pocket is in an inner region of the casing string. The method also includes transmitting data from the device to a downhole tool positioned downhole within the inner region of the casing string via a wireless communications link, and transmitting data from the downhole tool to a surface of the wellbore.

Example 14 is the method of example 13, further comprising: recharging a power source of the device via a downhole tool positioned within the inner region of the casing string while the device is positioned downhole in the side pocket of the casing string.

Example 15 is the method of examples 13-14, further comprising: removing a power source of the device while the device is positioned downhole in the side pocket of the casing string; and replacing the power source of the device while the device is positioned downhole in the side pocket of the casing string.

Example 16 is the method of examples 13-15, further comprising: transmitting data from the downhole tool to the device for updating a performance of the device.

Example 17 is the method of examples 13-16, further comprising; coupling a downhole tool to an adaptor of the device for recharging a power source of the device while the device is positioned downhole within the casing string.

Example 18 is the method of example 13-17, further comprising: collecting data regarding a downhole environment via an additional device positioned within an additional side pocket of the casing string; and transmitting data from the additional device to the downhole tool positioned downhole within the inner region of the casing string via a wireless communications link.

Example 19 is the method of example 18, further comprising: transmitting data from the device to the additional device via a wireless communications link.

Example 20 is the method of examples 13-19, wherein the step of collecting data regarding a downhole environment via a device within a side pocket of a casing string further comprises: collecting data regarding a downhole environment in an annulus between the casing string and the wellbore via a port in a wall of the casing string proximate the side pocket.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A wellbore assembly for use downhole in a wellbore, the wellbore assembly comprising:

a casing string comprising a mandrel, the mandrel including a side pocket in an inner region of the mandrel; and a downhole device positioned within the side pocket of the mandrel, the downhole device including an electronics package, a power source, and a transmitter for transmitting data from the downhole device via a wireless communications link to a downhole tool for transmitting the data to a surface of the wellbore for monitoring a downhole environment of the wellbore, wherein the power source and the transmitter are positioned within the side pocket and being removable from the downhole device, the electronics package being positioned within an annulus between the wellbore and the casing string for collecting data regarding at least one characteristic of the annulus between the wellbore and the casing string.

2. The wellbore assembly of claim 1, wherein the downhole device further includes an adaptor for coupling the downhole tool to the power source for recharging the power source via the downhole tool.

3. The wellbore assembly of claim 2, wherein the adaptor is a wet-stab connector.

4. The wellbore assembly of claim 1, wherein the electronics package further includes a receiver for receiving data from the downhole tool or from another downhole device via the wireless communications link for receiving data from the surface of the wellbore for managing a performance of the downhole device.

5. The wellbore assembly of claim 1, wherein the downhole device includes a region sized and shaped to couple to a downhole tool for positioning the downhole device within the side pocket of the mandrel while the casing string is downhole.

6. The wellbore assembly of claim 1, wherein the power source includes a region sized and shaped for coupling to a downhole tool for removing the power source of the downhole device from the downhole device while the downhole device is positioned in the side pocket of the mandrel.

7. The wellbore assembly of claim 1, wherein the mandrel further comprises a port within a wall of the mandrel for providing access between the side pocket and the annulus.

8. The wellbore assembly of claim 1, wherein the downhole tool is positioned within the wellbore, the downhole tool including a wireless receiver for receiving data from the downhole device via the wireless communications link.

9. The wellbore assembly of claim 1, wherein the downhole device includes at least one of a sensor, a valve assembly, or an actuator.

10. The wellbore assembly of claim 1, wherein the casing string comprises an additional mandrel having a side pocket; and an additional downhole device positioned within the side pocket of the additional mandrel, the additional downhole device including an electronics package and a power source.

11. The wellbore assembly of claim 10, wherein the additional downhole device is positioned at a distance to the downhole device for transmitting additional data via a wireless communications link to the downhole device for monitoring the downhole environment of the wellbore.

12. The wellbore assembly of claim 11, wherein the additional downhole device is positioned at a distance to the surface of the wellbore for transmitting data to a device at the surface of the wellbore.

13. A method of monitoring a downhole environment of a wellbore comprising:

collecting data regarding a downhole environment via an electronics package of a device positioned within a side pocket of a casing string, the side pocket in an inner region of the casing string, the electronics package being positioned within an annulus between the wellbore and the casing string for collecting data regarding at least one characteristic of the annulus between the wellbore and the casing string;

transmitting data from the device to a downhole tool positioned downhole within the inner region of the casing string via a wireless communications link; and transmitting data from the downhole tool to a surface of the wellbore.

14. The method of claim 13, further comprising:

recharging a power source of the device via the downhole tool positioned within the inner region of the casing string while the device is positioned downhole in the side pocket of the casing string.

15. The method of claim 13, further comprising:

removing a power source of the device while the device is positioned downhole in the side pocket of the casing string; and replacing the power source of the device while the device is positioned downhole in the side pocket of the casing string.

16. The method of claim 13, further comprising:

transmitting data from the downhole tool to the device for updating a performance of the device.

17. The method of claim 13, further comprising:

coupling the downhole tool to an adaptor of the device for recharging a power source of the device while the device is positioned downhole within the casing string.

18. The method of claim 13, further comprising:

collecting data regarding the downhole environment via an additional device positioned within an additional side pocket of the casing string; and transmitting data from the additional device to the downhole tool positioned downhole within the inner region of the casing string via a wireless communications link.

19. The method of claim 18, further comprising:

transmitting data from the device to the additional device via a wireless communications link.

20. The method of claim 13, wherein the casing string further comprises a port within a wall of the casing string for providing access between the side pocket and the annulus.

* * * * *